United States Patent [19]

Dutton

[11] Patent Number: 4,784,497

[45] Date of Patent: Nov. 15, 1988

[54] REFUSE RECEPTACLE

[76] Inventor: Warren A. Dutton, 1055 Los Robles Ave., Palo Alto, Calif. 94306

[21] Appl. No.: 87,616

[22] Filed: Aug. 20, 1987

[51] Int. Cl.[4] ..... B65D 33/24

[52] U.S. Cl. ..... 383/43; 383/907; 383/104; 229/41 P; 229/907

[58] Field of Search ..... 383/43, 104, 905, 11, 383/55, 907; 229/190, 41 R, 41 B, 907; 220/1 T

[56] References Cited

U.S. PATENT DOCUMENTS

| | | | |
|---|---|---|---|
| 2,774,531 | 12/1956 | Rosenthal | 383/11 |
| 3,455,498 | 7/1969 | Gadiel | 229/907 |
| 3,510,052 | 2/1970 | Ruda | 229/62 |
| 3,578,236 | 5/1971 | Arai | 229/55 |
| 3,589,595 | 6/1971 | White | 229/66 |
| 3,693,868 | 9/1972 | Rich | 229/56 |
| 3,743,172 | 7/1973 | Ackley et al. | 383/104 |
| 3,954,220 | 5/1976 | Foster | 229/27 |
| 3,980,225 | 9/1976 | Kan | 229/57 |
| 4,402,452 | 9/1983 | Kupersmit | 229/41 R |
| 4,657,176 | 4/1987 | Matsubara | 229/907 |

*Primary Examiner*—Willis Little

[57] ABSTRACT

A receptacle made of kraft paper or the like essentially a rectangular prism in form when expanded and ready for use which can be used to collect used food and drink containers; used tissues and napkins; apple cores, orange peelings and such. The construction allows the receptacle to be stored flat and yet to be readily expanded to become a rigid self-supporting receptacle with an easy opening and self-closing top closure.

12 Claims, 4 Drawing Sheets

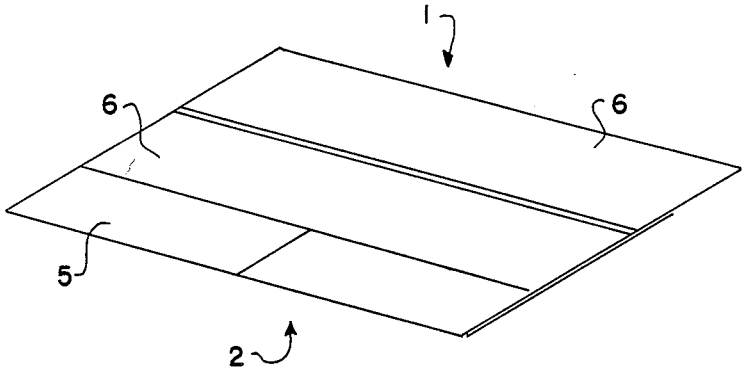
FIG. 3
FIG. 4
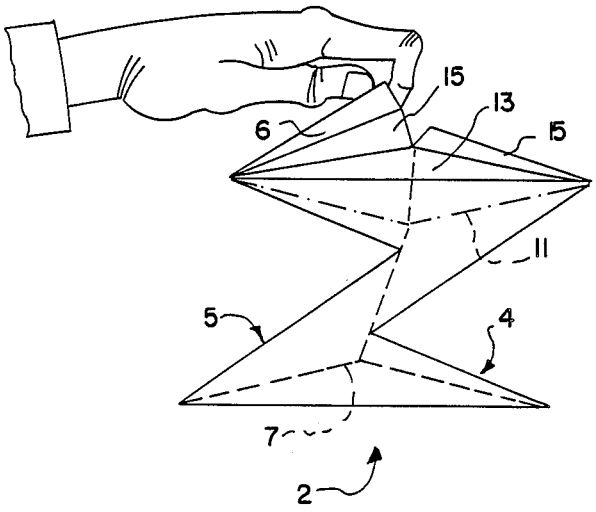

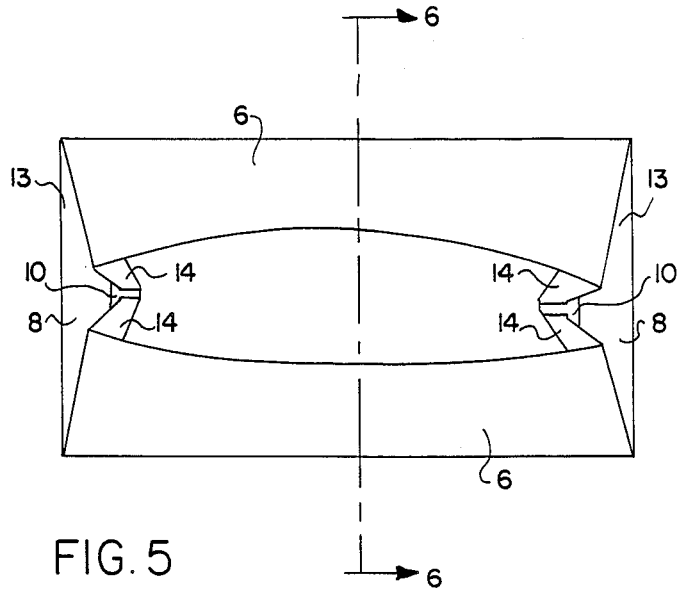
FIG. 5
FIG. 6
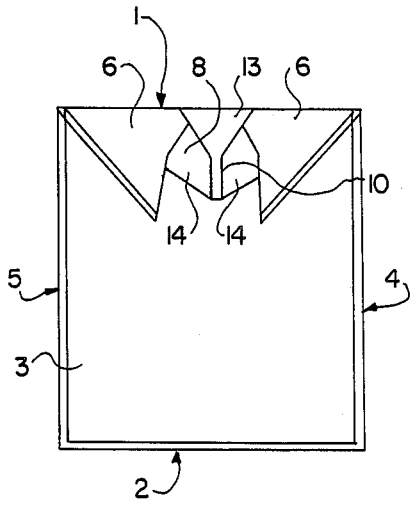

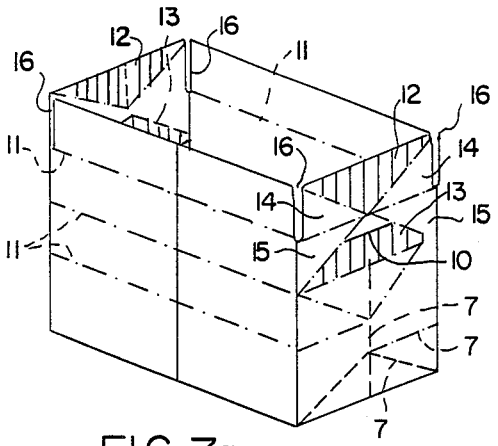
FIG.7a
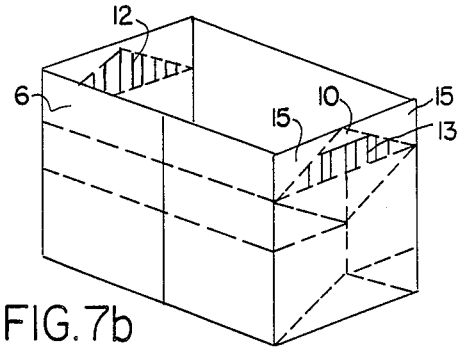
FIG.7b
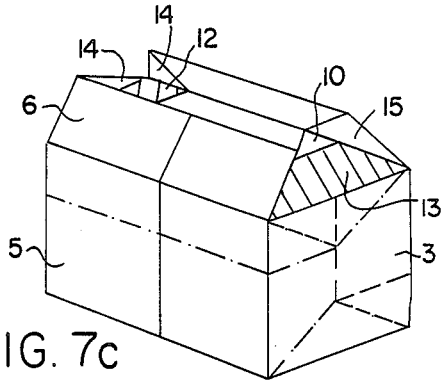
FIG. 7c
FIG.8
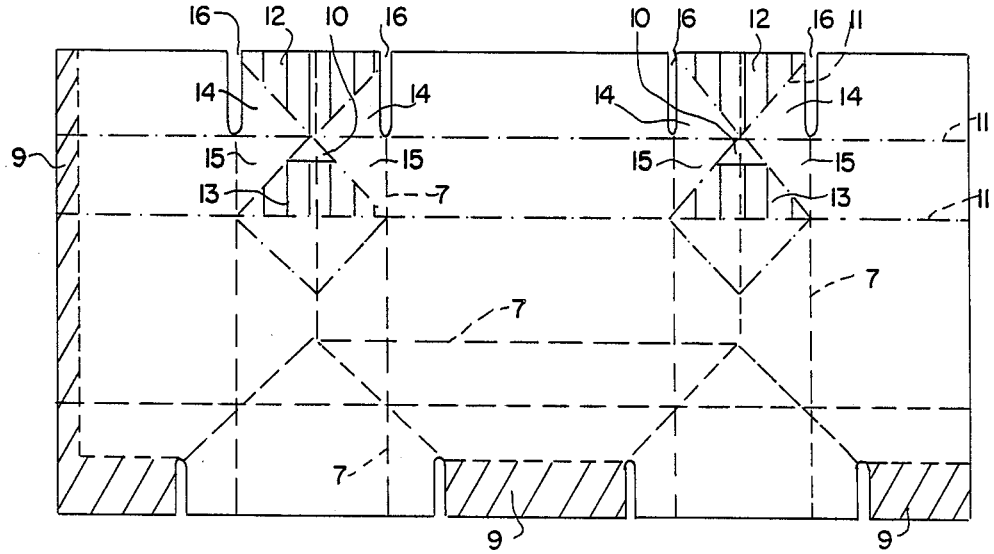

REFUSE RECEPTACLE

BACKGROUND

1. Field of Invention

This invention relates to disposable receptacle constructed of an inexpensive disposable material such as paper which can be stored flat and yet due to fold lines in each of its two sides and two end walls can be expanded into a self-supporting receptacle having the form of a rectangular prism. Said receptacle is useful as a depository for refuse such as empty drink cans, foam cups, orange peels, used tissues or other items generated where persons congregate such as automobiles, campers, boats, motels or hospital rooms. The invention relates specifically to the top closure of the receptacle which functions to maintain the expanded receptacle in its expanded self-supporting form while also allowing refuse to be passed into the interior by simply pushing the refuse through the closure. Once inside the refuse is kept from sight and prevented from spillage if the receptacle is accidentally overturned.

2. Description of Prior Art

Present means for collecting such refuse take many forms. Those available for automobiles are either rigid plastic boxes made to straddle the transmission hump or hung from the door or seat. Others are flat envelopes made of a flexible plastic material and require a method of mounting to a rigid item in the automobile. In most ases this type of refuse collecting means is not disposable.

In other disclosed means which are disposable, the means are not self-supporting as is the case in "Disposable Litter Bag", U.S. Pat. No. 3,510,052, which requires mounting to a rigid item for support. The "Self-standing Bag" disclosed in U.S. Pat. No. 3,980,225 although self-standing does not have any degree of resistance to tipping due to a limited width to height ratio inherent in the construction. The "Litter Bag" disclosed in U.S. Pat. No. 3,589,596 although self-supporting is dependent on the addition of a wire to the top of the bag to hold it open and specifies attachment to a stationary surface.

A plain brown paper bag rolled down at the top is applicable for collecting refuse but does not have a closure and leaves unsightly refuse in view. Accidental tipping also causes the refuse to spill from the open top.

OBJECTS AND ADVANTAGES

The invention here disclosed incorporates a unique top closure which allows an easy one-handed operation when disposing of refuse. With the present invention there is no need to open or fold back a lid or flap when inserting refuse in the receptacle nor is there need for the driver of a moving vehicle to remove his eyes from the road when disposing of refuse. The invention provides a true incentive to avoid the temptation to throw refuse out the window and add to the litter on our streets and highways.

Because available receptacles for collecting the refuse described are often not disposable, self-supporting and self-closing; it is therefore the object of this invention to provide a receptacle which is disposable, self-supporting and which possesses an easily opened and self-closing top closure. The additional objects of attractive appearance, including the option of printed designs and messages, and flat storage are also objects of this invention. Alternative material selection adds the object of moisture resistance.

DRAWING FIGURES

FIG. 3 shows the invention in the flat (folded) configuration prior to use.

FIG. 4 shows a side view of the invention in a partially unfolded configuration at it is being expanded.

FIG. 5 shows a top view of the invention as it would appear during use when a hand (not shown) with a used tissue is forcing the side and end flaps downward to allow the tissue to enter the receptacle.

FIG. 6 shows a section view taken along line 6—6 of FIG. 5 to further clarify the action of the top closure (side and end flaps) to allow refuse to enter the interior of the receptacle and to be entrapped therein. The thickness of the material through which the section passes has been exaggerated for clarity.

FIGS. 7A, 7B and 7C are a series of drawings showing the progressive folds utilized to form the final configuration from substantially a plain paper bag.

FIG. 8 shows a flat blank from which the invention can also be made in one of its preferred configurations.

DRAWING REFERENCE NUMBERS

1 is the top of the invention which is the top closure.
2 is the bottom of the invention which is a box type bag closure which is conventionally produced on high speed machinery.
3 is one of the end panels.
4 is a side panel with no seam.
5 is a side panel which contains the seam created when the bag is conventionally made from a web of roll stock material.
6 is one of the side closure flaps formed by folds made to the top portion adjacent a side panel.
7 are fold lines (shown as dash, dash lines) formed when the conventional open-mouthed bag portion of the receptacle is stored flat prior to its use.
8 is one of the closure end flaps formed by folds made to the top portion adjacent an end panel.
9 is adhesive used for construction of the original bag side seam and bottom closure.
10 is the adhesive used to hold the top closure flaps in place.
11 are folds lines (shown as a dash, dot line) utilized to create the top closure and to allow it to be stored flat.
12 are isosceles triangular shaped areas adjacent the end panels with the bases lying along the top opening of the bag.
13 are isosceles triangular shaped areas adjacent triangular shaped area 12 with the apexes of the triangles coincident and the bases parallel.
14 and 15 are right triangular shaped areas adjacent triangular shaped areas 12 and 13.
16 are optional slots.

DETAIL DESCRIPTION OF REFUSE RECEPTACLE

Figure 1:
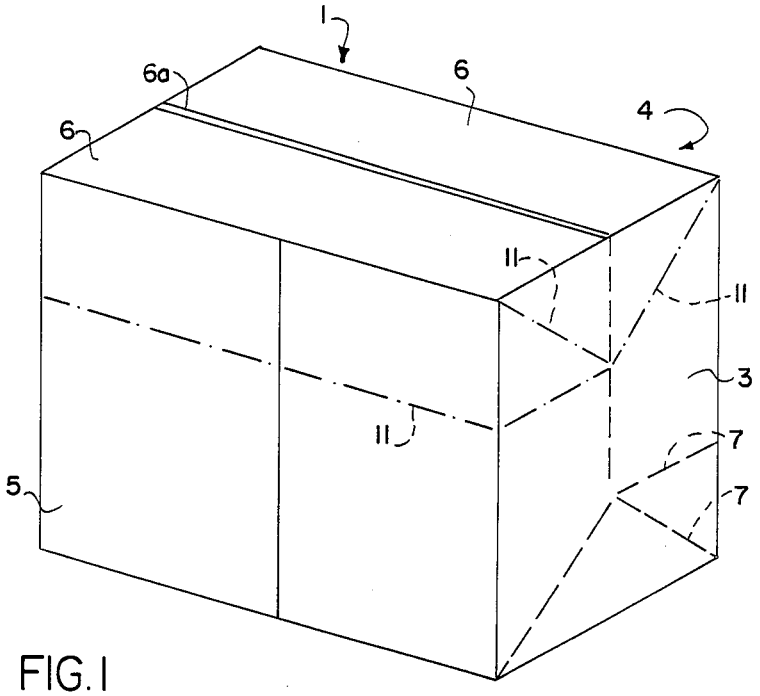
FIG. 1 shows a pictorial of the invention in the expanded open configuration ready for use.

The objectives of this invention are particularly useful when configured in the embodiment shown in FIG. 1. The embodiment consists of a top closure 1 which contains four flaps. Two of these closure flaps, 6,6, are extensions of the plain side 4 and the seamed side 5, and are visible in FIG. 1. Two other flaps 8,8 seen in FIG. 2, but not visible in FIG. 1, are extensions of the end panels 3. The folds lines 7 (dash, dash) are inward creases needed to allow the bottom box-type bag closure of receptacle to be stored flat. The fold lines 11 (dash, dot) are utilized to create and allow the folded top closure to be stored flat. A slot 6A is formed between opposing edges of closure flaps 6,6 which slot may be spread open by pressing downwardly on closure flaps 6,6 to allow passage of refuse into the receptacle. When the closure flaps 6,6 are released by spring back to the slot closed position shown in FIG. 1.

Figure 2:
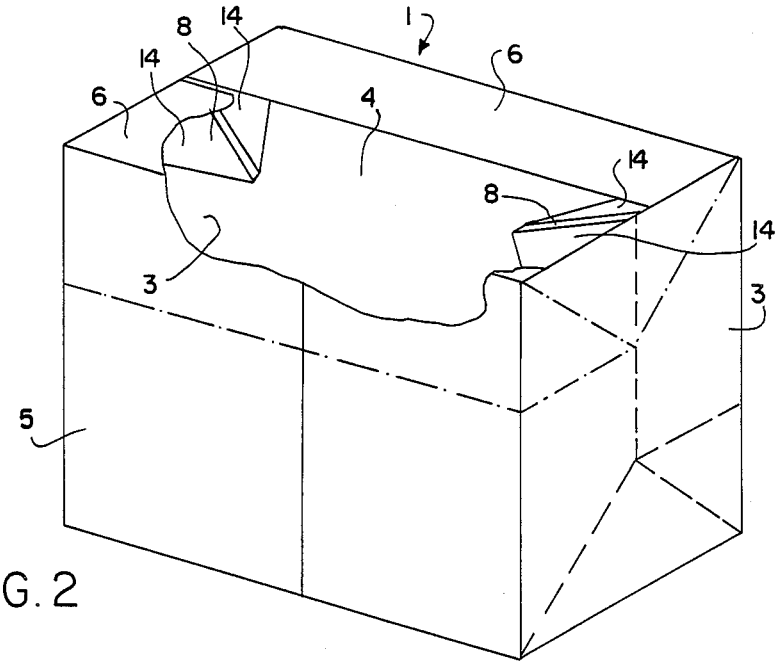
FIG. 2 is similar to FIG. 1 except one side flap and the adjoining side have been partially removed to show interior detail of the top closure.

FIG. 2 shows the same embodiment as FIG. 1 except in FIG. 2 one of the side flaps 6 and the seamed side 5 have been cut away to show detail not visible in FIG. 1. The position of the end flaps 8 are shown tilted 45° down from the horizontal, but may vary from being horizontal to pointing 90° downward with the apex of the triangular shaped end flap 8 pointing straight downward; however, in any position the triangular shape is inherently rigid and works to keep the top of the bag in its rectangular prism shape, box like, form which contributes significantly to the utility of the invention.

FIG. 3 shows the invention in the folded flat configuration prior to use. The top 1 and the bottom 2 are offset in the particular dimensional combination illustrated. The closure side flaps 6 and the seamed side 5 are also shown. To unfold the receptacle from the folded FIG. 3 configuration a user would simply grasp one of the side flaps and suspend the receptacle in a manner illustated in FIG. 4.

FIG. 4 is a side view of the receptacle in a partially open configuration suspended by a hand. The bottom 2, side panel 4 and seamed side panel 5 are also identified. The fold lines 7 and fold lines 11 can be seen functioning to allow the expansion of the receptacle. From this configuration the users other hand is placed inside the receptacle and rattled around in a manner to cause all of the fold lines to straighten out and to bring the receptacle into its "ready for use" configuration shown in FIG. 1.

FIG. 5 is a top view of the invention looking straight down on the top 1 in a configuration which would occur when a hand, not shown, were forcing a used tissue through the closure into the interior of the receptacle. The side flaps 6 are folded downward which also draws the end flaps 8 downward. The adhesive 10, which secures isoseles triangular shaped areas 13 to adjacent right triangular shaped areas 15 over part of their surfaces holds the closure in place, and is also identified.

FIG. 6 is a cross sectional view taken along line 6—6 of FIG. 5. The downward tilt and bowing of the side flaps 6 can be seen to open up the closure and allow the refuse to enter the receptacle. Adhesive 10 is again identified.

FIG. 7A shows substantially a standard paper bag, such as used by grocery stores, in an open configuration from which the novel receptacle of this invention may be formed. The fold lines 7 indicated by a dash, dash line are those used to fold the standard bag flat prior to use. The fold lines 11 indicated by the dash, dot lines are the folds used to create the top closure to which this disclosure refers. Optional slots 16 may be used to facilitate folding along the first fold line 11 below and parallel to the top opening. The area 12 and the area 13 are shown with stripes to help distinquish them during subsequent description and drawings which show how the top closure is formed by folding the upper portions of the side and ends of the original bag.

FIG. 7B shows the bag of FIG. 7A after the initial operation of folding the top portion of the two sides and the two ends inwardly. As can be seen, areas indicated by 12 and by 13 are now adjacent and coplanar. The top portion of the bag has been rolled inward along the appropriate fold lines. The ease of making this initial fold is facilitated by the optional slots 16.

FIG. 7C shows the area 13 being folded toward the center which pulls the side flaps 6 in toward the center also. As folding down of area 13 continues, the area 15,15 will come in contact with the adhesive area 10, shown here in dark shading, and the adhesive will hold the surfaces 13 and 15 together in the area of the adhesive and the appropriate fold lines will keep them adjacent.

FIG. 8 shows a flat blank from which the invention can be made as an alternative to starting a substantially standard bag as shown in FIG. 7A to which the top closure is added. The details of the bottom 2 closure are not critical; however, a typical popular configuration is shown for illustration. The fold lines 7 and 11, areas which receive adhesive 9 and 10, are cross-hatched and differentiated by number. Also, the area 12, 13, 14, and 15 are identified.

From the above, it will be apparent that the fully assembled receptacle of this invention is adapted to be stored in a flat folded condition, and is unfoldable to a useable expanded condition without the need for additional assembly such as insertion of flaps in slots, locking interengagement of cooperating elements of the receptacle, or the like.

Other schemes of folding the bag material, applying adhesive or of adding tape reinforcement to the top flaps as an alternative to the fold which doubles the material thickness of the side flaps 6 can be used to affect similar objectives of closure to the receptacle. Similarly, wire staples may be used in place of or in addition to the adhesive 10, to hold the top flaps in place. A choice between differing schemes and methods is dependent upon the machinery available for producing the end product. Obviously the invention is not limited to the preferred configuration shown for illustration.

I claim:

1. A disposable refuse receptacle, or the like, comprising a foldable bag which is adapted to be stored in a flat folded condition and unfoldable to a useable expanded condition, in the expanded condition said bag including opposing end panels and opposing side panels defining a rectangular horizontal crosssection, and a self-closing top closure integrally formed with said panels along upper edges thereof and including an elongated slot through which refuse may be passed, the receptacle being selfsupporting in the expanded condition of said foldable bag, said receptacle being in a fully assembled condition in the flat folded condition of said bag whereby no additional assembly is required to place the bag in the unfolded useable expanded condition.

2. A disposable refuse receptacle as defined in claim 1 wherein said top closure comprises a plurality of flaps which contribute to the rigidity of the receptacle in the expanded condition of the foldable bag, allow easy access to the interior of the receptacle, and prevent refuse from spilling out when the receptacle is overturned.

3. A disposable refuse receptacle as defined in claim 2 which is constructed of a printable material whereby the exterior surfaces may be decorated and printed.

4. A disposable refuse receptacle as defined in claim 2 which is constructed of a material which is treated to add moisture or oil resistance to the material.

5. A disposable refuse receptacle as defined in claim 4 wherein said material comprises paper.

6. A disposable refuse receptacle, or the like, comprising a foldable bag which is adapted to be stored in a flat folded condition and unfoldable to a useable expanded condition, in the expanded condition said bag including opposing end panels and opposing side panels defining a rectangular horizontal cross-section, and a self-closing top closure integrally formed with said panels along upper edges thereof and including an elongated slot through which refuse may be passed, the receptacle being selfsupporting in the expanded condition of said foldable bag, said top closure comprising first and second pairs of closure flaps, said first pair or closure flaps at opposing side panels of the bag being substantially rectangular in shape and said second pair of closure flaps at opposing end panels of the bag being substantially isosceles triangular in shape, said first and second pairs of closure flaps being pivotal about axes extending along the upper edges of said side and end panels, respectively.

7. A disposable refuse receptacle, or the like, comprising a foldable bag which is adapted to be stored in a flat folded condition and unfoldable to a useable expanded condition, in the expanded condition said bag including opposing end panels and opposing side panels defining a rectangular horizontal cross-section, and a self-closing top closure integrally formed with said panels along upper edges thereof and including an elongated slot through which refuse may be passed, the receptacle being selfsupporting in the expanded condition of said foldable bag, said top closure comprising a pair of substantially rectangular shaped closure flaps at opposing side panels of the bag which are pivotal about axes extending along the upper edges of said side panels, said rectangular shaped closure flaps normally being in a substantially plane position and having opposing elongated edges defining said elongated slot, when pivoted downwardly under pressure said rectangular shaped closure flaps being bowed so that said opposing elongated edges separate to enlarge the slot to allow for passage of refuse therethrough, said rectangular shaped closure flaps springing back to normal position upon release of pressure to prevent easy egress of refuse contained in the receptacle.

8. A disposable refuse container as defined in claim 7 including a pair of substantially isosceles triangular shaped flaps at the upper edges of said opposing end panels which flaps add stiffness to said end panels.

9. A disposable refuse container as defined in claim 7 wherein opposite ends of said rectangular closure flaps are attached to said triangular shaped flaps along fold lines extending parallel to the upper edges of said end panels.

10. A disposable receptacle as defined in claim 1 wherein said top closure comprises a pair of substantially rectangular shaped closure flaps at opposite side panels of the bag which are pivotal about axes extending along the upper edges of said side panels.

11. A disposable receptacle as defined in claim 6 which is constructed of paper material.

12. A disposable receptacle as defined in claim 7 which is constructed of paper material.

* * * * *